United States Patent [19]

Renner

[11] 4,182,390

[45] Jan. 8, 1980

[54] ROOF SHINGLE REMOVER TOOL

[75] Inventor: Jerome A. Renner, Slinger, Wis.

[73] Assignee: Harvey G. Kuhlman, Menomonee Falls, Wis.

[21] Appl. No.: 929,456

[22] Filed: Jul. 31, 1978

[51] Int. Cl.[2] ..... B66F 15/00

[52] U.S. Cl. ..... 145/1 A; 30/312; 254/25

[58] Field of Search ..... 145/1 A, 1 B, 1 R; 254/25; 30/312

[56] References Cited

U.S. PATENT DOCUMENTS

| | | | |
|---|---|---|---|
| 105,050 | 7/1870 | Dittman | 30/312 |
| 304,700 | 9/1884 | Brown | 254/25 |
| 466,066 | 12/1891 | Sheldon | 254/25 |
| 561,499 | 6/1896 | Detert | 254/25 |
| 795,876 | 8/1905 | Willhide | 254/25 |
| 3,987,827 | 10/1976 | Mills | 145/1 A |
| 4,009,743 | 3/1977 | Ackerman | 145/1 A |

FOREIGN PATENT DOCUMENTS

| | | | |
|---|---|---|---|
| 37893 | 7/1909 | Fed. Rep. of Germany | 254/25 |
| 1272777 | 8/1961 | France | 30/312 |

*Primary Examiner*—Robert L. Spruill
*Assistant Examiner*—J. T. Zatarga
*Attorney, Agent, or Firm*—Andrus, Sceales, Starke & Sawall

[57] ABSTRACT

A shingle removal tool includes a main supporting shaft having an outer handle and a shingle removing blade at the opposite end. Centrally of the supporting shaft, an angled arm is secured to and extends outwardly and upwardly for gripping by the opposite hand of the roofer. The blade has a first portion aligned with the shaft, formed with a plurality of different sized notches, and a lateral extension portion formed as a continuous chamfered blade. A side blade wall extends past the bottom end of the shaft and lifts the shingle.

9 Claims, 5 Drawing Figures

ROOF SHINGLE REMOVER TOOL

BACKGROUND OF THE INVENTION

This invention relates to a shingle removing tool adapted for manual manipulation by a roofer for removing of roofing shingles secured to an inclined roof.

Housing structures and the like are generally constructed with inclined roofs. The roofs are covered with a plurality of overlapping, horizontal, aligned rows of shingles. Generally, each row includes a plurality of horizontally aligned individual rectangular shingles. The first row is laid across the lowermost edge of the roof and nailed in place. Each successive layer or row is secured to the roof boards with the lower portion overlapping the preceding row sufficiently to cover the attaching nails of the immediately preceding lower row. In modern roofing, the overlapping portion is also secured to the bottom shingle by a suitable adhesive. Generally, the shingles are also laterally staggered such that the attached shingle overlies the joint of the adjacent shingles in the immediate preceding row. It is often necessary to remove the shingles for replacement either in part or in total. It is necessary, of course, to pry the nails upwardly to remove the shingles. Various tools have been suggested to assist the roofer in removing of the shingles. For example, U.S. Pat. No. 4,009,743 discloses an elongated handle having a flat lowered edge member adapted to project under a shingle with the outermost edge engaging the nail and with a rocker action loosening the nail to assist in the removal of the shingles. In addition to the patent cited in the above patent, reference may be made to U.S. Pat. No. 758,442, which was issued in 1904; U.S. Pat. No. 2,680,003 which issued in 1954, as indicative of other tools for assisting the roofer in removing of an existing shingled roofing.

SUMMARY OF THE PRESENT INVENTION

The present invention is particularly directed to a highly effective and improved shingle removal tool which can be readily operated by the roofer with a swinging type motion to rapidly and effectively remove nailed shingles from a roof. The tool includes means for releasing of the shingles and the nails to effectively remove the shingles without creating unnecessary unbalanced forces on the roofer. Generally, in accordance with the teaching of the present invention, the tool includes a main supporting shaft having an upper handle at one end and a special tool removing blade member of a significant width at the opposite end. The blade is specially formed having an outer elongated chisel edge with a portion of the blade chisel edge, preferably that portion aligned with the shaft, formed with a plurality of different sized notches, and a lateral extension portion formed as a continuous chamfered blade. In addition, generally, centrally of the length of the supporting shaft, an angled arm is secured to and extends outwardly and upwardly for gripping by the opposite hand of the roofer. The angular orientation from the angled arm provides convenient and balanced support during swinging of the tool. Thus, in operation the operator or the roofer moves the blade member tool beneath the shingles with a swinging motion across and through a row of the shingles. In addition, the tool can be employed as a lever member for loosening of a shingle nail, removing of individual shingles and the like.

BRIEF DESCRIPTION OF THE DRAWING

The drawing furnished herewith illustrates a preferred construction of the present invention in which the above advantages and features are clearly disclosed as well as others which will be readily understood from the following description.

In the drawing.

DESCRIPTION OF THE ILLUSTRATED EMBODIMENT

Figure 1:
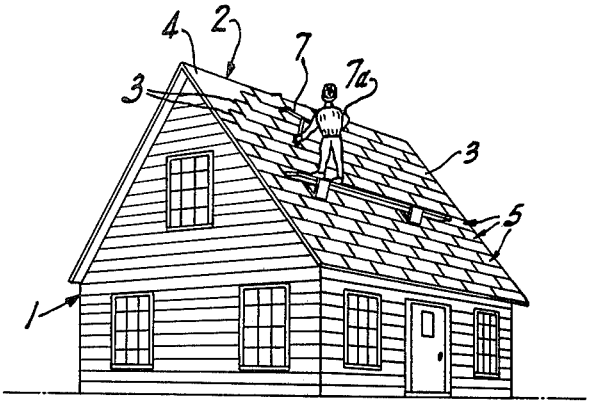
FIG. 1 is a pictorial view of a typical shingled house with a roofer using a shingle removal tool for removing of a composition shingle roof.

Referring to the drawing and particularly to FIG. 1, a conventional house is illustrated having a inclined roof 2 formed of a suitable wood base. Composition asphalt shingles 3 are secured to the roof boards 4 to seal the roof. The asphalt shingle roofing generally, in accordance with conventional practice, includes a plurality of overlapping horizontal rows 5 beginning at the lowermost edge or eave of the roof line and proceeding upwardly with similar rows, each additional row overlapping the row immediately beneath it. Each row, in turn, consists of a plurality of individual generally rectangular shingles 3 which are secured in place by nails 6 to extend through the upper portion of the shingle and through the roof boards.

A shingle removal tool 7 and roofer 7*a* are shown on the roof 2 with the tool 7 in position beneath the shingles 3 in the process of removing a plurality of the shingles 3.

Figure 2:
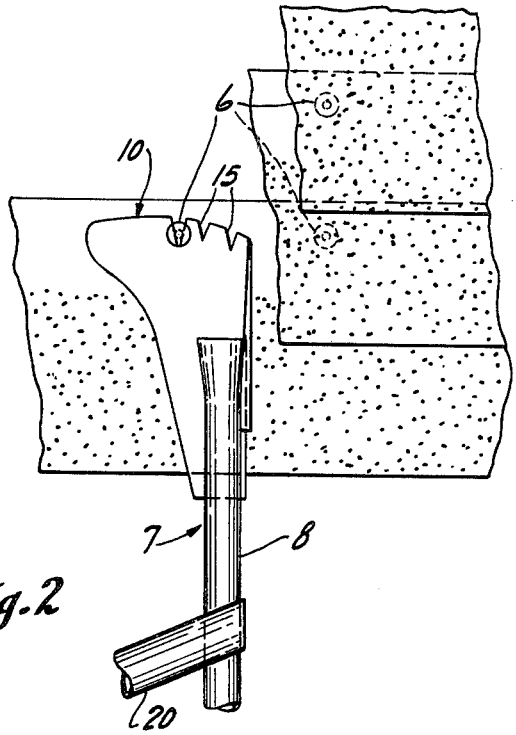
FIG. 2 is an enlarged view illustrating the positioning of the tool by the roofer for loosening the nail beneath a shingle.

The tool 7 can also be employed separately to remove a single shingle 3 as by loosening of a single nail 6 by individual, separate lifting of the nail 6, for example, as shown in FIG. 2.

Figure 4:
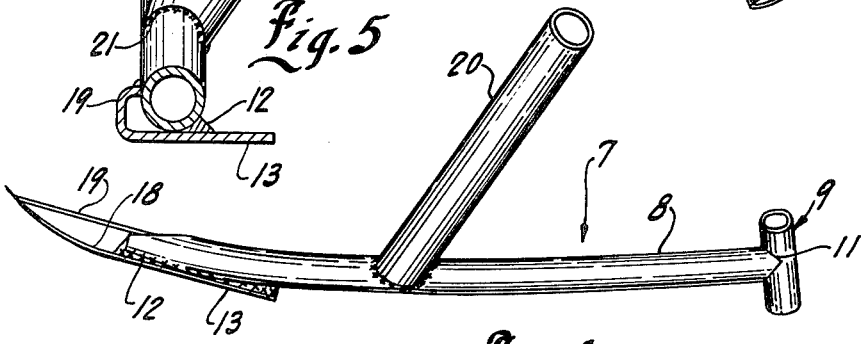
FIG. 4 is a side elevational view of the tool shown in FIG. 3.

More particularly, the novel shingle removal tool 7 includes a supporting shaft 8 which is provided with a hand handle 9 at the one outer end and a shingle removing blade 10 at the opposite end. The shaft 8, in the illustrated embodiment of the invention, is a rod-like member and is curved slightly from one end to the other as shown in FIG. 4. Shaft 8 can be conveniently formed of a conventional metal tubing. The handle 9 is similarly shown as a relatively short, laterally extending tubular member welded or otherwise secured to the outer end of the shaft 8 or at 11. The blade 10 in the illustrated embodiment of the invention is a separate, plate-like metal member which is rigidly affixed to the outer end of the shaft 8, as by welding 12. The shaft 8 is shown flattened and closed in FIG. 4. The blade 10 particularly includes a flat, shank portion 13 underlying the outer end of the shaft 8 and interconnected thereto by a suitable weld 12. The shank 13 may be a slightly tapered portion which merges with an enlarged laterally extending outer elongated chisel edge and portion defining an outer extended blade end 14. The blade end 14 is formed with two distinct portions. A first portion includes a plurality of notches 15, each of which is shown as a generally V-shaped notch separated from the adjacent notches by a relatively flat edge 16. The notches 15 may be formed of different depths to permit the application to different sized nails. The adjacent portion is shown as a smooth continuous blade portion 17 generally of the same order of length as the notched portion 15.

The blade 13 and its attachment to shaft 8 is further strengthened in the illustrated embodiment of the invention by a small upstanding side ledge 18 secured to the edge of the blade 13 immediately adjacent to the shaft 8 and extending from the shaft to the outermost end of the blade. It is formed to define a generally inclined top edge 19 such that as the tool moves under the shingles 3, the inclined edge will tend to lift the shingles 3.

Figure 3:
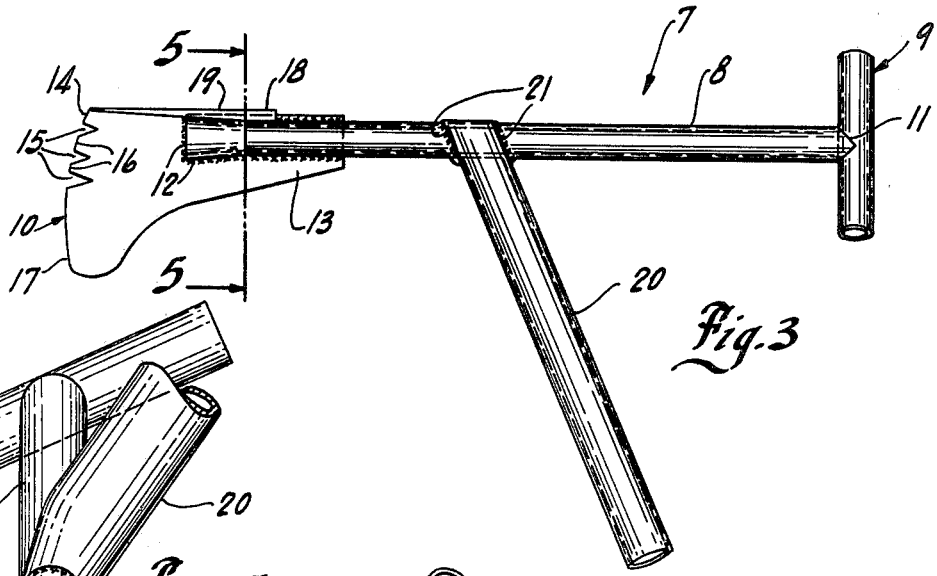
FIG. 3 is a top plan view of the removal tool shown in FIGS. 1 and 2.
Figure 5:
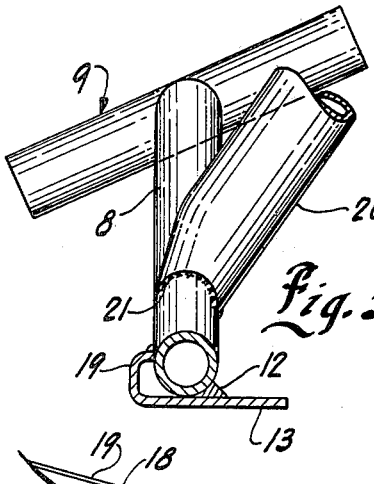
FIG. 5 is a vertical section taken generally on line 5—5 of FIG. 3.

Further, as most clearly shown in FIGS. 3–5 a lever and stabilizing handle 20 is secured centrally of the length of shaft 8. Handle 20 is shown a separate tubular member 20 of a somewhat greater diameter than that of the shaft 8 with its one inner end overlapping the shaft 8 and firmly affixed thereto by a weld 21. The handle extends laterally outwardly of the shaft 8 and slightly, rearwardly toward the first handle 9. The second handle 20 is generally in the same plane as the straight upper portion of the shaft 8 may be slightly angularly oriented with respect to such plane. The two handles 9 and 20 provide a very convenient means for gripping of the tool 7 for moving thereof with the desired swinging motion. The outer handle 9 is gripped by the right hand and the stabilizing handle 20 gripped at its outer end by the left hand of the roofer 7*a*. The roofer 7*a* swings the tool 7 with the blade 10 moving beneath the shingles 3 for loosening of the shingles from each other and from the roof 4. The notched edge 15 is adapted to move beneath the nail structure for raising of the nails and convenient removal of the nailed shingles.

Thus, in operation the tool is used generally with a swinging motion to effectively remove the shingles. In order to effectively loosen the nails, the notched edge may be located beneath a nail 6 with the blade resting on the roof portion immediately adjacent to the nail as shown in FIG. 2. The operator then merely bears down on the outer end of the shaft to effectively loosen the nail and permit the convenient removal.

The combination of the elongated extended blade having the straight blade portion in combination with a separate notched portion and particularly in combination with the stabilizing handle structure provides a highly effective tool for the rapid removal of the shingles.

Various modes of carrying out the invention are contemplated as being within the scope of the following claims, particularly pointing out and distinctly claiming the subject matter which is regarded as the invention.

I claim:

1. A shingle removal tool, comprising a support shaft member, a curved plate-like blade member secured to one end of said shaft member and having an elongated outer chisel edge, said blade member curving upwardly and outwardly of the handle and past the end of the shaft member, a first portion of said edge including a plurality of edge notches and another portion coextensive with the first portion and equal in length to at least two of said notches being essentially continuous, a handle member secured to the shaft member, and a guide handle secured to an intermediate portion of the shaft member between the blade member and the handle member and extending outwardly and slightly rearwardly.

2. The tool of claim 1 in which said shaft member is curved and extended upwardly and outwardly of the blade member.

3. The tool of claim 1 wherein said shaft member being fixedly secured to the plate-like blade member in alignment with the notched portion.

4. The shingle removal tool of claim 1 wherein said blade member is a metal plate having a lever plate secured to one side of the metal plate.

5. The shingle removal apparatus of claim 1 wherein said blade member is a metal plate having a shank portion secured to the shaft member, and having an outer enlarged portion terminating in said chisel edge, said notches being formed in the plate and chisel edge in alignment with the shaft member.

6. The tool of claim 1 wherein shaft member is secured to the blade member in spaced relation to the chisel edge and, said elongated outer chisel edge is curved and extends laterally of the shaft member in the direction of the guide handle, said notches being located in alignment with the shaft member.

7. The tool of claim 6 in which said shaft member is a tube having the outer end flattened and closed, said outer end being curved and extended upwardly and outwardly of the blade member.

8. The shingle removal tool of claim 6 wherein said blade member is a metal plate angularly oriented with respect to the plane of the shaft member and guide handle.

9. The tool of claim 8 having lever wall means fixedly secured to the edge of the plate and the shaft member and having an upper wall extending from the chisel edge to the shaft member and defining an inclined edge for lifting of a shingle.

* * * * *